US005860383A

United States Patent [19]

Whitener

[11] Patent Number: 5,860,383

[45] Date of Patent: Jan. 19, 1999

[54] DISPLACEMENT, SUBMERGED DISPLACEMENT, AIR CUSHION HYDROFOIL FERRY BOAT

[76] Inventor: Philip C. Whitener, 5955 Battle Point Dr., Bainbridge Island, Wash. 98110

[21] Appl. No.: 840,188

[22] Filed: Apr. 11, 1997

Related U.S. Application Data

[63] Continuation-in-part of Ser. No. 685,022, Jul. 22, 1996, Pat. No. 5,651,327, which is a continuation-in-part of Ser. No. 528,614, Sep. 15, 1995, abandoned.

[51] Int. Cl.[6] ..... B63B 1/00

[52] U.S. Cl. ..... 114/271; 114/274

[58] Field of Search ..... 114/67 A, 271, 114/278, 274, 258

[56] References Cited

U.S. PATENT DOCUMENTS

| | | | |
|---|---|---|---|
| 768,765 | 8/1904 | MacLean . | |
| 1,799,456 | 4/1931 | Cavert . | |
| 1,913,207 | 6/1933 | McDougall . | |
| 2,389,353 | 11/1945 | Foss . | |
| 2,672,840 | 3/1954 | Sharp et al. . | |
| 2,999,475 | 9/1961 | Kautz, Jr. | 114/67 A |
| 3,069,862 | 12/1962 | Ward . | |
| 3,320,918 | 5/1967 | Zalejski . | |
| 3,326,171 | 6/1967 | Zade . | |
| 3,590,762 | 7/1971 | Yuan | 114/278 |
| 3,742,888 | 7/1973 | Crowley | 114/67 A |
| 3,968,762 | 7/1976 | Meyer, Jr. | 114/67 A |
| 4,008,675 | 2/1977 | Johansson | 114/258 |
| 4,196,686 | 4/1980 | Moran | 114/67 A |
| 4,227,475 | 10/1980 | Mattox | 114/67 A |
| 4,350,107 | 9/1982 | Mattox | 114/67 A |
| 4,422,517 | 12/1983 | Hammerschlag | 114/67 A |
| 4,766,829 | 8/1988 | Schlichthorst | 114/67 A |
| 5,146,863 | 9/1992 | Ford | 114/67 A |
| 5,415,120 | 5/1995 | Burg | 114/67 A |
| 5,592,895 | 1/1997 | Schmidt | 114/274 |
| 5,623,889 | 4/1997 | Whitener | 114/230 |

FOREIGN PATENT DOCUMENTS

| | | |
|---|---|---|
| 3712534 | 4/1987 | Germany . |
| 60-163788 | 8/1985 | Japan . |
| 258048 | 11/1969 | Russian Federation . |
| 532548 | 10/1976 | Russian Federation . |
| 895341 | 5/1962 | United Kingdom . |
| WO 90/05660 | 5/1990 | WIPO . |

*Primary Examiner*—Jesus D. Sotelo
*Attorney, Agent, or Firm*—Christensen, O'Connor, Johnson & Kindness, PLLC

[57] ABSTRACT

The ferry boat has a rectangular main deck with superstructure above and hull structure below. The superstructure is essentially rectangular in all views and has one or more decks with a plurality of traffic lanes on each deck in addition to those on the main decks with optional passenger carrying compartments. The lanes are straight and parallel and there are no deck-to deck ramps. The hull structure has two sidewalls, one along each of the long sides of the main deck and two skirts, one at each end of the main deck. The skirts extend between the sidewalls and have vertical aft surfaces and front surfaces which slope downward and aft. The lower extremities of the sidewalls are further from the main deck than the apexes of the skirts. The volume enclosed by the sidewalls, skirts, main deck and water surface is filled with entrapped air which will compress to provide a major part of the support of the boat. There are two hydrofoils, one forward, one aft and extending between the sidewalls. Each foil is supported from the deck structure by several struts. The struts and foils have blunt trailing edges ventilated by air ducted down the struts. The foils are submerged about one chord length below the lower edges of the sidewall and the lower edges extend below the apexes of the dams.

25 Claims, 2 Drawing Sheets

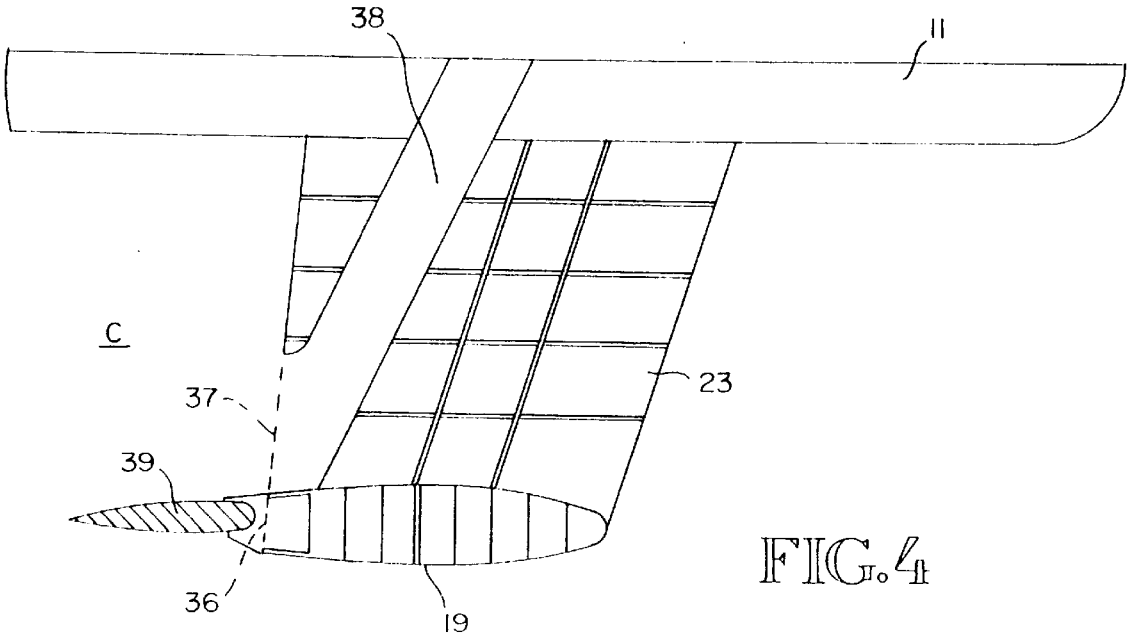
FIG. 4
FIG. 5
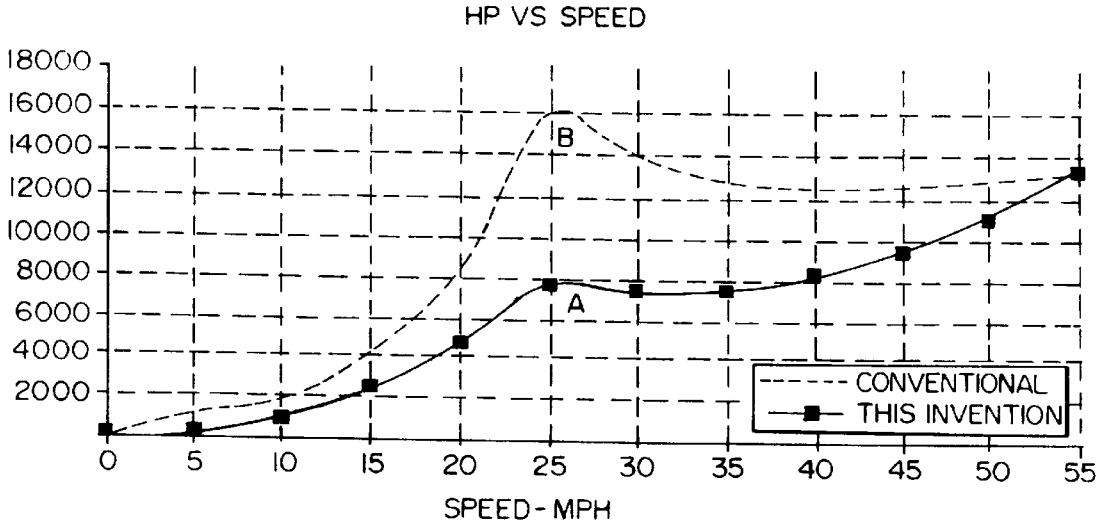

DISPLACEMENT, SUBMERGED DISPLACEMENT, AIR CUSHION HYDROFOIL FERRY BOAT

This application is a continuation-in-part application based on application Ser. No. 08/685,022, filed Jul. 22, 1996, now U.S. Pat. No. 5,651,327, which is a continuation-in-part application based on application Ser. No. 08/528,614, filed Sep. 15, 1995, now abandoned.

FIELD OF THE INVENTION

The subject invention is in the field of vessels intended for ferrying vehicles and passengers and of vessels which derive support from a captured quantity of air known as a bubble, which depend on the displacement provided by a body mounted below the main hull of the vessel on struts and which are equipped with hydrofoils for support and control. It is also in the field of vessels having a plurality of decks having a plurality of lanes for vehicles on each deck.

BACKGROUND OF THE INVENTION

There is well known prior art in all the fields cited above, including ferry boats having multiple decks with a plurality of lanes on each deck.

The patents listed below are a sampling of the prior art:

U.S. Pat. Nos. 1,799,456 2,672,840 3,742,888 4,008,675 4,227,475 4,196,686 4,422,517 4,766,829 5,146,863 5,415,120

Japan 60-163788

Soviet Union SU-532-548

British 895-341

U.S. Pat. No. 3,590,762 issued to Yuan discloses a land and water based vehicle equipped with hydro/air foils generally oval in shape with slotted trailing edges for jet flow therefrom and for circulation control of the flow around the foil to impart high lift to the foil for controlling the vehicle without the necessity for changing the angle of attack of the foil.

U.S. Pat. No. 3,742,888 issued to Crowley discloses a soft riding-stable multiple-chamber air cushioned boat hull having a plurality of high pressure air chambers around the periphery automatically providing heave stability as well as roll and pitch stability. The hull may further include a vent slot proving a means for exhausting the spill out of the continuously charged high pressure chambers and further makes a sharp reduction in the bow wave pressure. In addition to providing stability the high pressure chambers lift the boat providing a low friction, soft riding air cushioned support.

U.S. Pat. No. 3,968,762 issued to Meyer, Jr. teaches a water craft combining the physical and hydrodynamic features of a catamaran, hydrofoil and rigid sidewall air cushioned vehicle. The water craft is intended to operate as a multi-modal vehicle in the approximate speed range of 0–100 knots. The vehicle from at rest to operational speed, obtains its lift at first from 100% buoyancy of catamaran hulls, then from dynamic lift of hydrofoils, and finally from powered aerostatic lift from a captured air cushion. A combination of two or all lift modes may be used through speed changes and at intermediate speeds.

U.S. Pat. No. 4,008,675 issued to Johansson discloses a ship comprising a hull in which vehicles can be readily loaded and unloaded from at least two ramps at about the same level, the ramps communicating with a cargo-carrying portion extending through two decks and comprising fully separated cargo volumes, in which straight blind alleys emanating from lobbies within the hull at opposite ends of the hull communicate with mutually inclined decks extending upwardly and downwardly forward-aft and aft-forward, respectively, and in communication with respective opposite lobbies.

U.S. Pat. No. 4,196,686 issued to Moran teaches a sidewall drag reduction system for captured air bubble type surface effect ships having rigid surface-piercing sidewalls. Pressurized air is discharged vertically down into the surface effect ship air cushion chamber from platform ports, and horizontally into the air cushion chamber from nozzles located near the bottom of the internal surface of the sidewalls.

U.S. Pat. No. 4,422,517 issued to Hammerschlag discloses bow and stern seals for sidewall type air cushion vehicles for contacting , together with the sidewalls, the air cushion under the vehicle. They consist of a substantial number of more or less equidistant rods connected by flexible membranes, these rods being designed to hinge around a more or less common axis at substantially the top of the air cushion, the rods extending beyond their hinge points and being positioned by two sets of opposing air bags, one set of air bags acting on the extensions of the rods above the hinge points and the other set on the sections of the rods just below the hinge points. The membranes are attached with a large amount of slack so that the rods can rotate a very substantial amount relative to each other. As the air bags will allow the rods only to rotate a limited amount relative to each other, the membranes will not get tight, and the membranes and rods will not be exposed to the accompanying shock loads leading to membrane tear and rod breakage. The bags react upon the ship structure, which has air chambers connected to the bags with openings that can be closed off partially or completely, to change the response characteristics of the air bags and thereby of the seal.

U.S. Pat. No. 4,227,475 issued to Mattox discloses a waterborne air cushion vehicle having a flat rigid upper rectangular sheet like platform, a plurality of flat rigid longitudinal walls attached substantially at right angles thereto and depending therefrom substantially parallel with the major axis of the platform. The outermost two walls are disposed as sidewalls along respective edges of the platform. The vehicle is provided with flexible trough shaped skirts which are independently movable with respect to the walls. A source of pressurized air forces air into the skirts and also into air cushion chambers located beneath the platform. The flexible skirts provide for less shock and resistance from wave formations due to the compression of the skirts.

U.S. Pat. No. 4,350,107 issued to Mattox teaches a water borne air cushion vehicle having a flat rigid upper rectangular sheet-like platform, and a plurality of flat rigid longitudinal walls attached substantially at right angles thereto and depending therefrom substantially parallel with the major axis of the platform. Two of the walls are disposed as side walls along respective edges of the platform, and a plurality of longitudinally spaced laterally aligned arrays of flexible trough-shaped skirts are looped with a space therein and fastened along the longitudinal edge of the underside of the platform flush with, but movable with respect to adjacent pairs of the walls. The skirts are extendible to a lesser depth than that of the walls, and a source of pressurized air is admitted through apertures of fixed size at a relatively high pressure to the skirts. Also, low pressure air is admitted through variable sized openings remotely controlled and located beneath the platform in communication with at least four square or rectangular open bottom air cushion chambers disposed laterally in pairs. Each of the four square air cushion chambers is bounded by an adjacent pair of skirts and by an adjacent pair of walls, the depth of the walls and of the skirts being so related to the flow rate of the air that the vehicle is buoyant upon water. The walls protrude into the water sufficiently to prevent air spillage when the vehicle is urged longitudinally through the water by a propulsion system. The skirt air inlet openings are adapted to re-admit by reverse flow at least part of the compressed air in any one of the skirts independently in response to fugitive deflection of the skirts. The skirts are bag like structures attached along one side to the underside of the platform via a brace comprising a flexible sheet extending through the width of the skirt.

U.S. Pat. No. 4,766,829 issued to Schlichthorst discloses a catamaran-type cushion craft having two floats arranged space apart parallel to one another which are connected together at the top by a connecting structure which carries built in structures and which is sealed at the bottom by an air tight transverse deck. The connecting structure includes at least two transverse trussed girders arranged spaced apart behind one another, which at least partially contain transverse hollow cavities for passageways and line accommodating hollow cavities, with containers and longitudinal passage and supply elements being mounted at the front and/or rear sides of the double transverse trussed girders.

U.S. Pat. No. 5,146,863 issued to Ford discloses an air cushion displacement hull water vehicle that defrictionizes water flowing under the hull as the vehicle is propelled through the water. The hull includes a forward bow portion, an opposing aft end portion, a pair of sidewalls spaced from each other and extending there between the forward bow portion and the aft end portion, and a bottom wall extending between the forward bow portion and the aft end portion and between the pair of sidewalls. The bottom wall of the hull is recessed to define an air cushion region. An air supply device positioned within the interior of the hull communicates with the hull cushion region and is operable to supply pressurized air to the air cushion region to defrictionize water flow under the air cushion region.

U.S. Pat. No. 5,415,120 issued to Burg teaches a marine surface vehicle that includes pressurized supporting gas cushions in multiple hulls, normally catamaran-like sidehulls, where such pressurized supporting gas cushions support a majority of boat weight in operation. The preferred embodiment of the invention utilizes long fine pointed bow catamaran-like sidehulls that are in mechanical communication with a connecting hull structure. The long fine sidehulls offer performance advantages over a single large supporting gas cushion. Sidehull gas cushion outer sidewalls are preferably wider and deeper than inner sidewalls which insures maximum resistance coupled with maximum transverse stability in roll. Further, sidehull gas cushioned sidewalls optionally have angled to horizontal flatter surfaces forward and then transition to more rounded shapes aft which provides for a good pitch stability and minimum hydrodynamic resistance. The invention may include a hull on centerline that adds to stability in rough seas and gives a racy yacht-like appearance. Recesses in the sidehulls may include, at least in part, fixed and/or movable seals. Fixed seals may include inset vented steps to reduce wetted surface area. The recess gas pressurization system may include a controller to control pressures in individual recesses which allows at least some control of boat motions in rough seas. A further feature is the use of vertically oriented vented steps in the sides of the sidehulls to reduce wetted area drag when operating in rough seas. Another feature is the use of air flow turbulence generators on the underside, or wet deck, of the connecting hull structure to thereby increase static pressure lifting forces acting on the connecting hull structure.

PCT application No. WO 90/05660 filed by Brown discloses a ferry vessel having a main vehicle deck space and twin extended longitudinal casings having at their extremities large longitudinally closing watertight doors to divide the main vehicle space into three watertight compartments thereby limiting possible flooding of the vehicle deck in a side compartment due to damage such as collision, or to the center compartment upon breaching of bow or stern door. In the event of center compartment flooding, the intact outboard compartments provide substantial righting moment against listing. To further reduce the likelihood of flooding arising from side damage, the vehicle deck levels outboard of the casings may be raised to increase the vehicle's freeboard and the hull subdivision transverse bulkheads carried up such that their tops form a stepped V. Still further reduction of floodable areas is achieved by a system of transversely located floodgates.

Japanese patent publication 60-163788 discloses a car ferry with car carrying decks arranged in multilayers in a ship. The car carrying decks are formed into multiple band like partial decks serving as travel paths for car wheels. The band like partial decks are fitted on support cross beams arranged at a distance from each other. Since the car carrying decks are arranged only where car wheels are located, the hull weight can be largely reduced and the production cost of the hull can be decreased.

Russian patent publication No. SU-532-548 teaches a multideck car ferry having loading recesses that are positioned one above another on both sides of the ship. Ramps are mounted in loading recesses for car access to the main deck of the ship.

In metropolitan areas involving islands and related waterways, increasing population generates increasing needs to facilitate traffic flow across the waterways. These needs can be met by building bridges and/or by using and improving ferry systems. Obviously each approach to meeting the increasing needs has its relative advantages and disadvantages.

A need thus exists to improve the ratio of advantages to disadvantages for ferry systems, particularly the vessels used in the system, by improving the ratio of traffic flow rate capability of the vessels relative to their sizes as expressed in terms of their displacements.

A further need exists for a vessel capable of high speed, such as 40 to 50 knots, without creating unacceptable wake and with a low power to weight ratio and good fuel efficiency.

An additional need exists for a maximized ratio of usable to total deck space.

Another need exists for traffic flow onto, through and off the vessel virtually free of impediment caused by lane changing and/or use of ramps and ramp adjustment.

A final need exists for a vessel that is economical to construct and operate, and provides passenger comfort.

SUMMARY OF THE INVENTION

The subject invention is a ferry boat having a high traffic flow rate capability relative to its size and weight (displacement). For purposes of this disclosure the terminology "traffic flow rate capability" means the number of vehicles the vessel can transport from one terminal to another per unit of time and includes factors such as vessel speed, carrying capacity and loading and unloading time. The subject boat is supported by displacement of water when at rest. Under way it is supported at various speeds by a combination of an air cushion, displacement provided by strut supported foils, planing of portions of the hull termed skirts and the hydrofoil action of the foils.

The boat comprises a rectangular main deck structure. Below the deck structure there is hull structure comprising two sidewalls, each extending from end to end of the deck and positioned along a long edge of the deck structure. Also, the hull structure comprises two elements termed skirts for purposes of this disclosure. The skirts are parallel to the ends of the boat, one being located near the bow and the other near the stern. Each skirt has a vertical aft surface and a forward surface which slopes down and aft from the main deck structure to the lower edge of the aft surface which is the apex of the skirt. The sloped surface of each skirt is a planing surface which helps lift the hull out of the water and air entrained in the water passing over the surface helps to replenish the air in the cushion (bubble). In operation of the boat the cavity enclosed by the sidewalls, skirts, main deck and water surface is filled with trapped air which provides a significant part of the support of the boat. This volume of air is termed a bubble. The lower extremities of the sidewalls are farther from the main deck structure than the apexes of the skirts. In an alternate embodiment of the subject invention the skirt near the stern may be of flexible construction.

Two hydrofoils are installed on the hull, one forward, one aft. The span of the foils equals or exceeds the width of the deck. They are supported by struts at each end, extending downward from the deck structure and by intermediate struts. The foils are located about one chord length below the lower edges of the sidewalls. The aft (trailing) edges of the foils and struts are blunt and are ventilated by air ducted down the struts and along the trailing edges and the entrained air helps replenish the air in the bubble. Adjustable trailing edge flaps for use at low speeds are stowed in the air cavity behind the foil at high speed. Stability and control are achieved by adjusting the flaps and/or the foils.

When the boat is at rest it is supported by the displacement of the foils, struts deck structure (hull), and air trapped under the hull. At low speeds support is derived from the buoyancy (displacement) of the hull, skirts, struts and hydrofoils and the trapped air under the hull. At intermediate speeds the support is derived from the planning surfaces of the skirts and hydrodynamic action of the foils, along with lessened support from the air cushion and hull displacement. At cruising speeds most of the hull is clear of the water surface and support is derived by the displacement and hydrodynamic action of the foils along with support derived from dynamic pressurization action of the air cushion.

As the boat gains speed (takes off) most of the drag is produced by the hull and increases approximately with the square of the speed. At all speeds the drag is less with the air cushion than it would be for an equivalent conventional displacement hull. The wave drag of the hull at given speeds is a function of the square of the pressure in the air cushion. As the support from the foils increases with increasing speed, the pressure required in the cushion to maintain equilibrium will decrease, resulting in rapid reduction of wave drag. The adiabatic expansion of the air also reduces the amount of replenishment air required. Friction drag is also reduced as the boat rises out of the water. Increasing speed results in decreasing induced drag of the foils. The result of all these factors is that the "hump drag" experienced with prior art hydrofoil boats and air cushion vessels is largely eliminated. This permits designing the propulsion system by cruise conditions and passenger comfort is enhanced by the relatively effortless take off.

The superstructure may comprise one to three more decks, each having working area essentially equal to that of the main deck. Each of the decks has a plurality of straight parallel lanes and there are no traffic connections between the decks. This arrangement is made feasible by a loading/unloading ramp facility invented by the inventor of the subject invention. The ramp facility enables loading and unloading the subject boat a deck at a time with all lanes on the deck being served emptying or filling simultaneously. This arrangement makes all the working surface of all the decks available for transporting vehicles.

The superstructure is configured to accommodate automobiles, buses, trucks and/or trains as well as walk on passengers. Propulsion is provided by turbine or diesel engines driving varidirectional hydrodynamic thrusters or surface piercing propellers.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 4 is a sectional view taken at 4—4 in FIG. 3; and

FIG. 5 is a typical horsepower versus speed curve for the subject boat.

DETAILED DESCRIPTION OF THE PREFERRED EMBODIMENT

Figure 1:
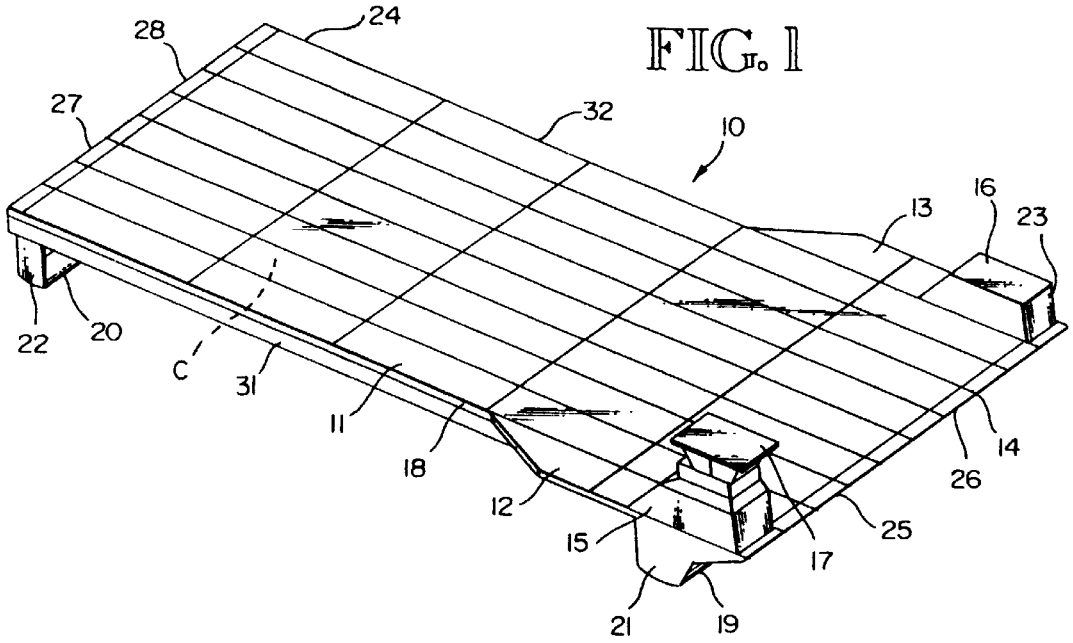
FIG. 1 is a perspective view of a basic embodiment of the subject invention.

The subject invention is a ferry boat designed to provide a high traffic flow capability relative to its size and displacement. As shown in FIG. 1 the boat 10 has a rectangular basic deck 11 having extended portions or wings 12 and 13 near bow 14. Housings 15 and 16 cover the power plants and control cabin 17 is supported on housing 15. When the boat is at rest it is supported by buoyant displacement of the hull 18 and strut supported hydrofoils 19 and 20 along with the air trapped under the hull (air cushion). The hydrofoils 19 and 20 are attached to the hull by struts 21 and 22, respectively, similar struts 23 and 24 on the other side of the hull, respectively, and intermediate struts 25, and 26, and 27 and 28, respectively. Struts 21, 23, 25 and 26 can be seen in FIG. 3.

Figure 2:
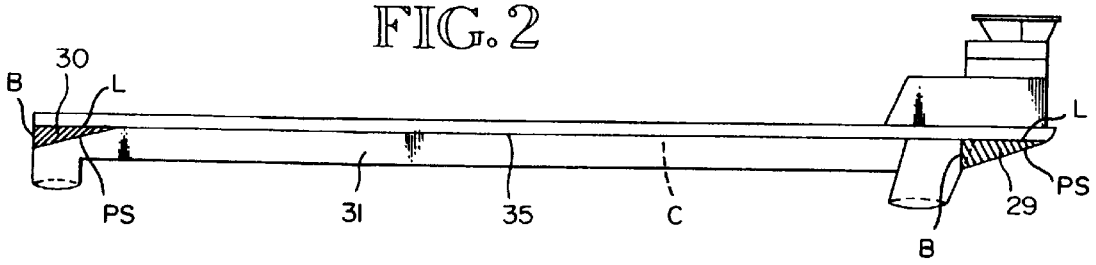
FIG. 2 is a side view of the embodiment of FIG. 1.

FIG. 2 is a side view of boat 10. The shaded areas show the cross section size, shape and location of skirts 29 and 30 which extend the full width of the hull between sidewall 31 and sidewall 32, see also FIG. 3. In an alternate embodiment of the subject invention skirt 30 may be of flexible construction. Skirts 29 and 30 are preferably disposed at an angle between parallel and perpendicular with respect to the horizontal surface of the water to provide at least partial support of hull 18 when boat 10 travels at low and intermediate speeds. Each of skirts 29 and have a cross sectional shape preferably defining a substantially right triangle with leg L being substantially parallel to the longitudinal axis of hull 18, with base B being substantially perpendicular to the longitudinal axis of hull 18 such that leg L and base B form a substantially right angle. Thus, planing surface PS is the hypotenuse of the cross sectional triangle formed by planing surface PS, base B and leg L. Planing surfaces PS of skirts 29 and 30 are thus preferably disposed at an angle between parallel and perpendicular with respect to the horizontal surface of the water to provide at least partial support of hull 18 when boat 10 travels at low and intermediate speeds.

Figure 3:
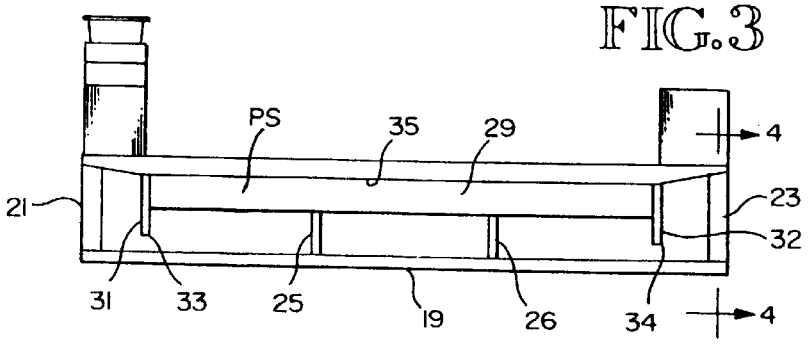
FIG. 3 is an end view of the embodiment shown in FIG. 1.

FIG. 3 is a view of boat 10 from the bow 14. Struts 21, 23, 25 and 26, skirt 29, foil 19 and sidewalls 31 and 32 are visible. As shown, foil 19 may extend beyond the sidewalls 31 and 32 and be attached to extended portions or wings 12 and 13. When the boat is initially under way the lower edges 33 and 34 of the sidewall 31 and sidewall 32, respectively, are immersed in the water. The boat 10 planes on the skirts 29 and 30, and on a quantity of air termed a bubble enclosed in a cavity C bounded by the water surface, by the dams, by the sidewall 31 and sidewall 32, and by underside 35 of the hull 18. Most preferably, central wall 35*a* is longitudinally disposed on underside 35 of hull 18 to longitudinally bisect cavity C to form two air bubbles to support boat 10.

FIG. 4, a sectional view taken at 4—4 in FIG. 3, shows details of the hydrofoils, for example foil 19, and their installation. Trailing edge 36 of foil 19 and trailing edge 37 of strut 23 are blunt and ventilated by air provided through duct(s) 38. Without ventilation, the pressure in cavity C will approach the vapor pressure of water. This low pressure will cause air in duct 38 to flow into cavity C. Engine exhaust gasses may also be introduced into the duct 38 to augment the airflow into cavity C. This air will be entrained into the high speed water at the air/water boundary and released into the air bubble in cavity C at a pressure approaching the dynamic pressure of the water. The trailing edge 36 of foil 19 and the trailing edge 37 of strut 23 may be open, perforated or some combination of the two, and air exiting the trailing edges 36 and 37 of the forward foil 19 and strut 23, respectively, thus helps fill the air bubble in cavity C. Trailing edge flaps 39 adjacent trailing edge 36 of foil 19 may be provided for use at low speeds. The trailing edge flaps 39 may be stowed in the foil 19 adjacent cavity C at higher speeds. Stability and control are achieved by adjusting the trailing edge flaps 39 and/or the foils 19. While duct 38 is shown on strut 23, it is to be understood that other ducts may also be present, or may be present in place of duct 38, in strut 21.

In operation of boat 10, when boat 10 is at rest in the water, it is supported by the displacement in the water of foils 19 and 20, struts 21, 22, 23, 24, 25, 26, 27 and 28, skirts 29 and 30, and hull 18. At low speeds, boat 10 is supported in the water by displacement of foils 19 and 20, struts 21, 22, 23, 24, 25, 26, 27 and 28, hull 18, and, additionally, air trapped in air cavity C under hull 18. At intermediate speeds, support for boat 10 in the water is provided by planing surfaces PS of skirts 29 and 30 and the hydrodynamic action of foils 19 and 20 along with lessened support from the air in air cavity C and displacement of hull 18. At cruising speeds, all of hull 18, most of sidewalls 31 and 32, and most to all of the skirts 29 and 30 are clear of the water surface, and support for boat 10 in the water is derived by displacement and hydrodynamic action of foils 19 and 20, along with optional support from the dynamic pressurization of the air bubble within air cavity C.

FIG. 5 is a plot of horsepower required versus speed. Curve A relates to the subject boat 10 and curve B generally illustrates the power required for pure hydrofoil vessels and for air cushion vessels. As shown, curve A is almost linear whereas curve B illustrates that hydrofoil and air cushion craft require as much or more power during the transition from idle to cruise conditions as for cruise conditions. These curves illustrate that the interactions of the hydrofoils, planing surfaces and air cushion action and pressure make the subject boat 10 comparatively significantly less costly to operate than other vessels able to cruise at speeds in the 40- to 50-knot range. This is particularly true for ferry boat operation in which the trips are short and frequent, requiring frequent transition between at rest and cruise conditions.

In a preferred embodiment the boat 10 is propelled by surface piercing propellers which can be raised and lowered to suit operating conditions. Thrust reversing panels may be used to help decelerate the boat 10.

The present invention provides a boat 10 having a high ratio of traffic flow rate capability to its displacement. The boat 10 is capable of speeds in a range of 40 to 50 knots without creating unacceptable wakes and with a low power to weight ratio and good fuel efficiency. Virtually all the space of deck 11 of boat 10 is usable for handling traffic onto, through and off the boat 10. There is no impediment to traffic flow caused by use of ramps, ramp adjustments or lane changes. The boat 10 structure is simple and economical, comprising primarily flat surfaces on deck 11 and being highly suitable for modular construction using prefabricated units of structure.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A powered boat having at least one deck with a fore end, an aft end, said deck on a hull, said hull comprising:

walls attached to said hull to form an air cavity under said hull, said walls including a least one of a front wall and a rear wall, said at least one of a front wall and a rear wall having a fixed sloped water-contacting planing surface; and at least two hydrofoils longitudinally spaced apart under said hull such that said hull is variably supported on the water by air in said air cavity under said hull, by said sloped water-contacting planing surface, and by said hydrofoils as boat speed varies, said sloped water-contacting planing surface providing support for the hull in an intermediate boat speed between stationary and a hydrofoil-supported speed.

2. The powered boat of claim 1 wherein said at least two hydrofoils includes a front hydrofoil and a rear hydrofoil and at least one of said front hydrofoil and said rear hydrofoil having a width greater than the width of said deck.

3. The powered boat of claim 1 wherein said front wall and said rear wall both have a fixed sloped water-contacting planing surface, such that said fixed sloped water-contacting planing surfaces both provide support at said intermediate boat speed.

4. The powered boat of claim 1 wherein said deck is substantially rectangular.

5. The powered boat of claim 1 further comprising means for providing supplemental airflow into said air cavity.

6. The powered boat of claim 5 wherein said means for providing supplemental airflow includes means for diverting engine exhaust into said air cavity.

7. The powered boat of claim 5 wherein said at least two hydrofoils includes a front hydrofoil and said front hydrofoil is attached to said deck by struts, said front hydrofoil and said struts having trailing edges, and said means for providing supplemental airflow includes ducts that pass air through said struts, out of openings in said trailing edges of said struts and of said front hydrofoil, and into said air cavity.

8. The powered boat of claim 1 wherein said at least two hydrofoils includes a front hydrofoil and a rear hydrofoil and said front hydrofoil and said rear hydrofoil each have a trailing edge with an adjustable flap laterally disposed thereon.

9. A powered boat having at least one deck on a hull, said hull comprising:

a front wall, sidewalls and a rear wall attached to said deck to form a fixed air cavity under said hull, at least one of said front wall and said rear wall having a sloped water-conducting planing surface;

a front hydrofoil adjacent said front wall; and a rear hydrofoil adjacent said rear wall such that said deck is variably supported on the water by air in said air cavity under said deck, by said sloped water-contacting planing surface, and by said front hydrofoil and said rear hydrofoil as boat speed varies, said sloped water-contacting planing surface providing support for the hull in an intermediate boat speed between stationary and a hydrofoil-supported speed.

10. The powered boat of claim 9, wherein at least one of said front hydrofoil and said rear hydrofoil has a width greater than the width of said deck.

11. The powered boat of claim 9 wherein said front wall and said rear wall both have a fixed sloped water-contacting planing surface, such that said fixed sloped water-contacting planing surfaces both provide support at said intermediate boat speed.

12. The powered boat of claim 9 wherein said deck is substantially rectangular.

13. The powered boat of claim 9 further comprising means for providing supplemental airflow into said air cavity.

14. The powered boat of claim 13 wherein said means for providing supplemental airflow includes means for diverting engine exhaust into said air cavity.

15. The powered boat of claim 13 wherein said front hydrofoil is attached to said deck by struts, said front hydrofoil and said struts having trailing edges, and said means for providing supplemental airflow includes ducts that pass air through said struts, out of openings in said trailing edges of said struts and of said front hydrofoil, and into said air cavity.

16. The powered boat of claim 9 wherein said at least two hydrofoils includes a front hydrofoil and a rear hydrofoil and said front hydrofoil and said rear hydrofoil each have a trailing edge with an adjustable flap laterally disposed thereon.

17. A powered boat having at least one deck on a hull, said hull comprising:

a front wall, sidewalls and a rear wall attached under said deck to form an air cavity under said hull, said front wall and said rear wall each having a sloped water-contacting planing surface spanning the width of said deck;

a front hydrofoil adjacent said front wall and at least spanning the width of said deck; and a rear hydrofoil adjacent said rear wall and at least spanning the width of said deck such that said deck is variably supported on the water by air and said air cavity under said deck, by said sloped water-contacting planing surfaces, and by said front hydrofoil and said rear hydrofoil as boat speed varies.

18. The powered boat of claim 17 wherein at least one of said front hydrofoil and said rear hydrofoil has a width greater than the width of said deck.

19. The powered boat of claim 17 wherein said deck is substantially rectangular.

20. The powered boat of claim 17 further comprising means for providing supplemental airflow into said air cavity.

21. The powered boat of claim 20 wherein said means for providing supplemental airflow includes means for diverting engine exhaust into said air cavity.

22. The powered boat of claim 20 wherein said front hydrofoil is attached to said deck by struts, said front hydrofoil and said stunts having trailing edges, and said means for providing supplemental airflow includes ducts that pass air through said struts, out of openings in said trailing edges of said struts and of said front hydrofoil, and into said air cavity.

23. The powered boat of claim 17 wherein said at least two hydrofoils includes a front hydrofoil and a rear hydrofoil and said front hydrofoil and said rear hydrofoil each have a trailing edge with an adjustable flap laterally disposed thereon.

24. A powered boat having at least one deck with a fore end, an aft end, said deck on a hull, said hull comprising:

walls attached to said hull to form an air cavity under said hull, said walls including at least one of a front wall and a rear wall, said at least one of a front wall and a rear wall having a sloped water-contacting planing surface; and at least two hydrofoils longitudinally spaced apart under said hull, said at least two hydrofoils comprising a front hydrofoil and a rear hydrofoil, at least one of said front hydrofoil and said rear hydrofoil having a width greater than the width of said deck, such that said hull is variably supported on the water by air in said air cavity under said hull, by said sloped water-contacting planing surface, and by said hydrofoils as boat speed varies.

25. A powered boat having at least one deck on a hull, said hull comprising:

a front wall, sidewalls and a rear wall attached to said deck to form a fixed air cavity under said hull, at least one of said front wall and said rear wall having a sloped water-conducting planing surface;

a front hydrofoil adjacent said front wall; and a rear hydrofoil adjacent said rear wall at least one of said front hydrofoil and said rear hydrofoil having a width greater than the width of said deck, such that said hull is variably supported on the water by air in said air cavity under said hull, by said sloped water-contacting planing surface, and by said hydrofoils as boat speed varies.

* * * * *